US009721691B2

(12) United States Patent
Tsechanski

(10) Patent No.: US 9,721,691 B2
(45) Date of Patent: Aug. 1, 2017

(54) MOLYBDENUM-CONVERTER BASED ELECTRON LINEAR ACCELERATOR AND METHOD FOR PRODUCING RADIOISOTOPES

(75) Inventor: Alexander Tsechanski, Omer (IL)

(73) Assignee: Ben-Gurion University of the Negev, Research and Development Authority, Beer Sheva (IL)

( * ) Notice: Subject to any disclaimer, the term of this patent is extended or adjusted under 35 U.S.C. 154(b) by 305 days.

(21) Appl. No.: 14/239,567

(22) PCT Filed: Aug. 22, 2012

(86) PCT No.: PCT/IL2012/000316

§ 371 (c)(1), (2), (4) Date: Feb. 19, 2014

(87) PCT Pub. No.: WO2013/027207

PCT Pub. Date: Feb. 28, 2013

(65) Prior Publication Data

US 2014/0192942 A1 Jul. 10, 2014

(30) Foreign Application Priority Data

Aug. 25, 2011 (IL) ..... 214846

(51) Int. Cl.

*G21G 1/00* (2006.01)
*G21G 1/12* (2006.01)
*G21G 1/10* (2006.01)

(52) U.S. Cl.

CPC ..... *G21G 1/001* (2013.01); *G21G 1/12* (2013.01); *G21G 1/10* (2013.01)

(58) Field of Classification Search

CPC G21G 1/001; G21G 1/12; G21G 1/10; G21G 2001/0036; G21G 2001/0042; G21G 1/0005

(Continued)

(56) References Cited

U.S. PATENT DOCUMENTS 2,983,817 A * 5/1961 Earley ..... G01N 23/222 250/255
5,784,423 A * 7/1998 Lidsky ..... G21G 1/12 376/156

(Continued)

FOREIGN PATENT DOCUMENTS

EP 0990238 A 5/2006

OTHER PUBLICATIONS

Malykhina, T.V., Torgovkin, A.A., Torgovkin, A.V., Uvarov, V.L., Shevchenko, V.A., Shlyakhov, I.N., & Shramenko, B.I. (2008). The research of mixed X,n-radiation field at photonuclear isotopes production. Voprosy Atomnoj Nauki i Tekhniki, 5(50), 184-188. Translation attached.*

(Continued)

*Primary Examiner* — Jack W Keith
*Assistant Examiner* — Lily C Garner
(74) *Attorney, Agent, or Firm* — Roach Brown McCarthy & Gruber, P.C.; Kevin D. McCarthy

(57) ABSTRACT

The present invention provides a method for producing molybdenum-99 comprising: i) providing an electron accelerator; ii) providing a molybdenum converter/target unit (Mo-CTU) comprising one or more metallic components, wherein each one of said metallic components is made of a material selected from the group consisting of natural molybdenum, molybdenum-100, molybdenum-98, and mixtures thereof; iii) directing an electron beam generated via said electron accelerator onto said Mo-CTU to produce a braking radiation (bremsstrahlung); iv) employing said bremsstrahlung onto said Mo-CTU to produce molybdenum-99 and neutrons via a photo-neutron reaction; v) slowing down the neutrons produced in step iv) with a low atomic liquid, e.g. distilled water; and optionally vi) employing the neutrons produced in step iv) to produce a (Continued)

complementary amount of molybdenum-99 via a neutron capture reaction on said Mo-CTU. The invention further provides an apparatus for producing molybdenum-99.

11 Claims, 1 Drawing Sheet

(58) Field of Classification Search
USPC ..... 376/186, 260, 190, 156
See application file for complete search history.

(56) References Cited

U.S. PATENT DOCUMENTS

| | | | | |
|---|---|---|---|---|
| 5,802,439 | A | 9/1998 | Bennett | |
| 9,196,388 | B2 * | 11/2015 | Clayton | G21G 1/001 |
| 9,318,228 | B2 * | 4/2016 | Gentile | G21G 4/02 |
| 2008/0240330 | A1 * | 10/2008 | Holden | G21G 1/12 376/190 |

OTHER PUBLICATIONS

Fisher, Darrell R. "Medical Isotope Production and Use." Office of National Isotope Programs (2009). Available online: <https://www.isotope.gov/outreach/presentations/MedicalIsotopeProductionandUse.pdf>.*

Supplementary European Search Report for a counterpart foreign application—6 pages, mailed Mar. 9, 2015.

T.V. Malykhina et al. "The research of mixed X,n-radiated field at photonuclear isotopes production", Problems of Atomic Science and Technology, 2008. No. 5. Series: Nuclear Physics Investigations, vol. 2008, No. 5 Jan. 1, 2008, pp. 184-188.

International Search Report for PCT/IL2012/000316—3 pages, mailed Dec. 27, 2012.

International Search Report—corrected—for PCT/IL2012/000316—2 pages, mailed Nov. 24, 2013.

Tsechanski et al., Electron accelerator-based production of molybdenum-99; Bremsstrahlung and photoneutron generation from molybdenum vs. tungsten, Nuclear Instruments and Methods in Physics Research B 366 (2016) 124-139.

* cited by examiner

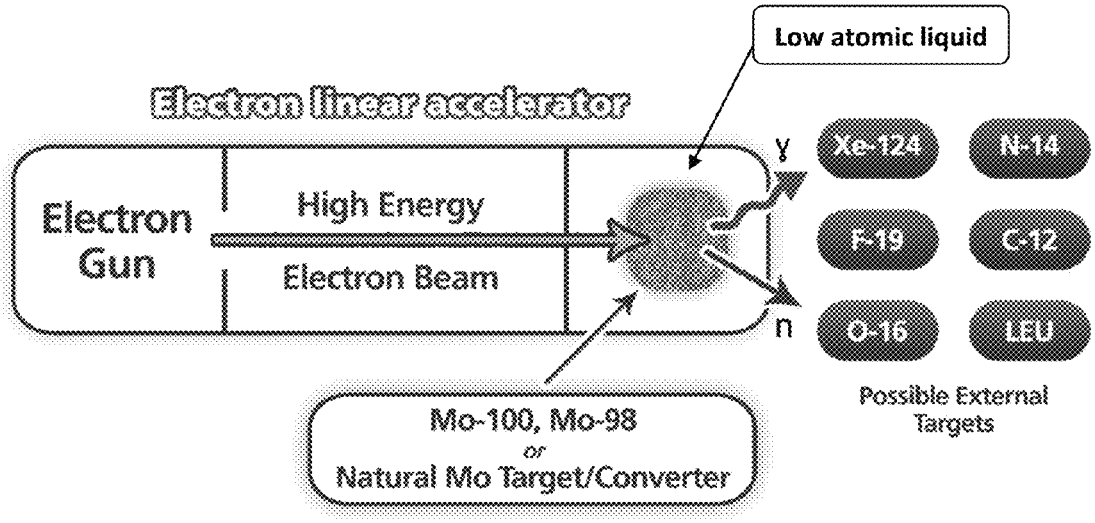
Low atomic liquid
Electron linear accelerator
Electron Gun
High Energy
Electron Beam
γ
n
Xe-124
N-14
F-19
C-12
O-16
LEU
Possible External Targets
Mo-100, Mo-98
or
Natural Mo Target/Converter

MOLYBDENUM-CONVERTER BASED ELECTRON LINEAR ACCELERATOR AND METHOD FOR PRODUCING RADIOISOTOPES

FIELD OF THE INVENTION

The present invention relates to the field of radioisotopes production, and more particularly to an apparatus and a method for the production of Molybdenum-99 and other radioisotopes.

BACKGROUND OF THE INVENTION

During the last years, the world of Nuclear Medicine has experienced a number of times severe shortages of radioisotopes for different diagnostic procedures. The most prominent of these radioisotopes is Molybdenum-99 (Mo-99) which is used as a precursor for Tc-99m. This latter isotope is used in more than 80% of nuclear imaging tests for detecting cancer, heart disease and other medical conditions. Each day, hospitals and clinics around the world use Mo-99/Tc-99m in more than 60,000 diagnostic procedures.

As for now, the state-of-the-art technology for producing the most important radioisotopes for nuclear medicine (such as Mo-99, I-131, I-125, Xe-133) is based on irradiation of highly enriched uranium (HEU) targets in dedicated nuclear reactors. More than 95% of the present world production of Mo-99 employs neutron fission (n,f) process. It uses an intense thermal neutron beam from a nuclear reactor irradiating a HEU (U-235) target thus producing Mo-99 in 6.161% of all fission events according to the following reaction:

$$U\text{-}235+n=\text{Mo-}99+\text{Sn}13x+\nu^{*}n \qquad \text{(Eq. 1)}$$

The irradiation of 1 g of U-235 target for 7 days in a typical thermal neutron flux of $7*10^{13}$ n/cm$^2$/s results in approximately 140 Ci of Mo-99 with very high specific activity of more than $10^4$ Ci/g Mo. However, it should be pointed out that the Mo-99 production from the neutron fission (n,f) of U-235 requires very elaborate and very expensive processing facilities. In addition, extreme precautions must be taken to avoid contamination of the Mo-99 with highly toxic fission products and transuranics. This results in high capital investment and running costs, which, in turn, yields in the high cost of producing 1 Ci (n,f) fission Mo-99 being more than four times higher than the cost of 1 Ci of Mo-99 by other methods.

In addition, this approach suffers from two main global problems. The first is that all such five nuclear reactors (one in Canada, three in Europe, and one in South Africa) producing together roughly 90% of the global Mo-99 requirements are very old ("geriatric") reactors with an average age of 47 years. As a result, these reactors are frequently shut down for unscheduled and time-consuming repair and routine maintenance and, in any case, all of them are close to total decommissioning. The second problem is that the US administration recently began to oppose vigorously the use of HEU for production of radioisotopes because its use endangers the Nuclear Non-Proliferation Treaty (NPT) and nuclear safety in general.

As of now, there is no generally accepted scientific and technological strategy to exit this crisis. One of the proposals mentioned recently is to check the possibility of using a photo-fission (γ,f) reaction by means of a high-power electron linear accelerator instead of thermal neutron fission in a nuclear reactor. In other words, this method relates to electron accelerator production of Mo-99 via the (γ,f) reaction on uranium target instead of the (n,f) reaction in nuclear reactors. In the case of photo-fission, there is no need in HEU since the natural or, at the most, low enriched uranium (LEU) can be used for this purpose. The Mo-99 producing reaction, in this case, can be summarized by the reaction below:

$$U\text{-}238+\gamma=\text{Mo-}99+\text{Sn}13x+\nu^{*}n \qquad \text{(Eq. 2)}$$

The other possibility is based on the photo-neutron, i.e. (γ,n), process in which the heaviest stable isotope of molybdenum, Mo-100 (isotopic abundance of 9.63%), has been irradiated by bremsstrahlung photons from an electron linear accelerator target. The Mo-99 producing reaction, in this case, can be summarized by the reaction below $$\text{Mo-}100+\gamma=\text{Mo-}99+n \qquad \text{(Eq. 3)}$$

Both in the case of the (γ,f) and (γ,n) reactions, the source of gamma radiation is a linear accelerator of electrons with an energy up to 50 MeV and an electron beam power up to 500 kW. The target of such accelerator, which converts the kinetic energy of an accelerated electron beam into bremsstrahlung (braking radiation) should be chosen from the high atomic number (Z) metals such as $_{73}$Ta, $_{74}$W, depleted U, in order to maximize the bremsstrahlung yield. In such a case, a target to be irradiated, the isotope Mo-100 (for production of radioisotope Mo-99/Tc-99m) has to be attached to the source of the bremsstrahlung target (converter) assembly as close as possible. However, because of the low efficiency of bremsstrahlung production and because of the considerable self absorption of the produced bremsstrahlung radiation in high-Z body of the bremsstrahlung target, this target must effectively be cooled down by distilled water under pressure. All this does increase the distance between the bremsstrahlung source and the sample to be irradiated (Mo-100) and significantly decreases the yield of Mo-99 production. Techniques and apparatus for the production of radioisotopes can be found for instance in the following publications:

U.S. Pat. No. 5,784,423 relates to the production of radioisotopes by exposing a targeted isotope in a target material to a high energy photon beam to isotopically convert the targeted isotope. In particular, the invention is used to produce Mo-99 from Mo-100.

U.S. Pat. No. 5,802,439 relates to the production of $^{99m}$Tc compositions from $^{99}$Mo-containing materials.

The art has so far failed to provide an efficient method and system to overcome the aforementioned drawbacks of the prior art. It is therefore an object of the present invention to provide an apparatus for producing Mo-99 radioisotope.

It is a further object of the invention to provide a method for the production of Mo-99 radioisotope.

These and other objects of the invention will become apparent as the description proceeds.

SUMMARY OF THE INVENTION

In one aspect the invention is directed to a method for producing molybdenum-99 comprising:

i) providing an electron accelerator;

ii) providing a molybdenum converter/target unit (Mo-CTU) comprising one or more metallic components, wherein each one of these metallic components is made of a material selected from the group consisting of natural molybdenum, molybdenum-100, molybdenum-98, and mixtures thereof;

iii) directing an electron beam generated via said electron accelerator onto said Mo-CTU to produce a braking radiation (bremsstrahlung);

iv) employing said bremsstrahlung onto said Mo-CTU to produce molybdenum-99 and neutrons via a photo-neutron reaction;

v) slowing down the neutrons produced in step iv) with a low atomic liquid, e.g. distilled water; and optionally vi) employing the neutrons produced in step iv) to produce a complementary amount of molybdenum-99 via a neutron capture reaction on said Mo-CTU.

Typically, production and accumulation of the isotope Mo-99 is carried out in the Mo-CTU itself located inside the target assembly of the linear accelerator.

In one embodiment of the invention the high fluxes of high energy bremsstrahlung photons and neutrons that are found around the target assembly outside the accelerator are used to produce other radioactive isotopes via the (γ,n) and (n,γ) reactions on the appropriate target materials placed outside the accelerator target assembly and adjacent to it. For instance, an external target of the stable isotope Xe-124 can be used to produce simultaneously the primary radioisotope Mo-99 inside the accelerator Mo-CTU and two radioisotopes of iodine: I-123 via the (γ,n) reaction and I-125 via the (n,γ) reaction.

Furthermore, the short-lived radioisotopes F-18, O-15, N-13, and C-11 (which are used for instance in Positron Emission Tomography or PET) can be produced by placing an external target of the appropriate stable isotope adjacent to the accelerator target assembly.

In a further embodiment of the invention the high flux of high energy bremsstrahlung photons exiting the accelerator target assembly is used for photo-fission (γ,f) of LEU samples placed outside the accelerator target assembly and adjacent to it.

In another aspect the invention is directed to apparatus for producing molybdenum-99, comprising:

a) an electron accelerator;

b) a molybdenum converter/target unit (Mo-CTU) comprising one or more metallic components, wherein each one of these metallic components is made of a material selected from the group consisting of natural molybdenum, molybdenum-100, molybdenum-98, and mixtures thereof;

c) means for directing an electron beam generated via said electron accelerator onto said Mo-CTU to produce a braking radiation (bremsstrahlung);

d) means for directing said bremsstrahlung onto said Mo-CTU to produce molybdenum-99 and neutrons via a photo-neutron reaction; and e) a low atomic number liquid, e.g. distilled water, for slowing down the neutrons produced in step d).

BRIEF DESCRIPTION OF THE FIGURE

FIG. 1 schematically illustrates an electron linear accelerator according to one embodiment of the invention.

DETAILED DESCRIPTION

Reference is made to FIG. 1. To overcome the drawbacks of the prior art, the present invention employs a bremsstrahlung producing converter/target unit made from molybdenum (Mo-CTU). In this way, the molybdenum target to be irradiated with the bremsstrahlung is ideally located in the bremsstrahlung radiation focus, thus maximizing the production of Mo-99 via the (γ,n) reaction. In addition, the use of molybdenum directly as a bremsstrahlung converter/target unit enables using the neutrons produced by the reactions (γ,n), (γ,2n), (γ, pn), and so on, for the complementary production of Mo-99 via the (n,γ) reaction on the isotope Mo-98 (when present in the Mo-CTU, for instance in natural molybdenum or in pure form Mo-98):

$$\text{Mo-98}+n=\text{Mo-99}+\gamma \qquad \text{(Eq. 4)}$$

Isotopic abundance of the isotope Mo-98 in natural molybdenum is 2.5 times higher than that of Mo-100 and amounts to 24.13%. It means that in such a case, Mo-99 will be produced simultaneously from the two stable isotopes of molybdenum: both from Mo-100 (9.63%) via the (γ,n) reaction and from Mo-98 (24.13%) via the (n,γ) reaction. It should be pointed out that in order to maximize the second channel for the Mo-99 production via the (n,γ) reaction, the neutrons from the first (neutron producing) channel should be slowed down to the epithermal/thermal energy interval. For this purpose, a low atomic number liquid, e.g. distilled water, which was intended primarily for cooling down of the target assembly of the electron linear accelerator can be used for neutron slowing down too.

In the method of the invention, production and accumulation of the isotope Mo-99 has been carried out in the Mo-CTU itself located inside the target assembly of the linear accelerator. Therefore, high fluxes of high energy bremsstrahlung photons and neutrons (many MeV's energy range) are found around the target assembly outside the accelerator. These high energy bremsstrahlung photons can be used to produce some other very important radioactive isotopes via the (γ,n) reaction on the appropriate target materials placed outside the accelerator target assembly and adjacent to it. For example, placing an external target of the stable isotope Xe-124, enables the simultaneous production of the primary radioisotope Mo-99 (inside the accelerator Mo-CTU) and of two important radioisotopes of iodine: I-123 via the (γ,n) reaction and I-125 via the (n,γ) reaction.

Moreover, short-lived radioisotopes like F-18, O-15, N-13, and C-11 for use in Positron Emission Tomography (PET) can be also produced in this way by placing an external target from an appropriate stable isotope adjacent to the accelerator target assembly. All this occurs simultaneously with the production and accumulation of the primary radioisotope Mo-99 in the Mo-CTU inside the linear accelerator. In addition, the high flux of high energy bremsstrahlung photons exiting the accelerator target assembly can be used for photo- fission (γ,f) of LEU samples placed outside the accelerator target assembly and adjacent to it.

It should be pointed out that the photonuclear accelerator-based technique in general has several advantages: 1) natural or depleted uranium (U-238) target can be used, thereby obviating problems of security and NPT; 2) the electron accelerator can be turned on and off at will; 3) an electron accelerator is inexpensive to decommission at end-of-life; 4) the electron accelerator-based technology promises to be scalable.

All the above description has been provided for the purpose of illustration and is not intended to limit the invention in any way. As will be apparent to the skilled person the invention allows exploiting different products of the reaction, and to use different targets, all of which results in a flexible, safe and economic method and system.

The invention claimed is:

1. An electron accelerator based method for producing molybdenum-99 (Mo-99) comprising:

i) providing an electron accelerator producing a high energy electron beam;

ii) providing one molybdenum converter/target unit (Mo-unit) comprising molybdenum-100 (Mo-100) wherein said Mo-unit simultaneously serves both as a braking radiation (bremsstrahlung) converter and a radioisotope production target; and iii) directing said electron beam onto said Mo-unit, thereby producing braking radiation (bremsstrahlung) which subsequently reacts in the same Mo-unit with said Mo-100 via the (γ,n) reaction to produce Mo-99 in said Mo-unit, in which the Mo-99 product accumulates;

wherein said Mo-unit further comprises molybdenum-98 (Mo-98), the method further comprising slowing down the neutrons produced in step iii) with a low atomic number liquid and reacting them with said Mo-98 via the (n,γ) reaction to produce additional Mo-99 in said Mo-unit, thereby maximizing the efficiency in the production of Mo-99.

2. The electron accelerator based method of claim 1 for producing Mo-99 and other radioisotopes, further comprising the step of placing one or more external target materials outside the Mo-unit and adjacent to it so that said bremsstrahlung photons and neutrons around said Mo-unit generate further radioactive isotopes via (γ,n) and (n,γ) reactions on said one or more external target materials.

3. The method of claim 2, wherein said external target materials comprise Xe-124, and wherein said further radioactive isotopes are I-123 and I-125.

4. The method of claim 2, wherein said external target materials are selected from F-19, O-16, N-14 and C-12, and wherein said further radioactive isotopes are F-18, O-15, N-13 and C-11, respectively.

5. The method of claim 2, wherein said external target materials comprise low enriched uranium (LEU) which is used in a photo-fission (γ,f) reaction.

6. An electron accelerator based apparatus for producing molybdenum-99 (Mo-99), comprising:

a) an electron accelerator producing a high energy electron beam;

b) one converter/target unit made from molybdenum (Mo-unit) comprising molybdenum-100 (Mo-100) wherein said Mo-unit serves both as a braking radiation (bremsstrahlung) source and as a radioisotope production target; and c) means for directing said electron beam onto said Mo-unit to produce braking radiation (bremsstrahlung) which subsequently reacts with said Mo-100 via the (γ,n) reaction to produce and accumulate Mo-99 in said Mo-unit;

wherein said Mo-unit further comprises molybdenum-98 (Mo-98), the apparatus further comprising a low atomic number liquid which slows down said neutrons produced in the (γ,n) reaction, the neutrons subsequently reacting with said Mo-98 via the (n,γ) reaction to maximize the efficiency in the production of Mo-99.

7. The apparatus of claim 6, wherein the low atomic number liquid is distilled water.

8. The method of claim 1, wherein said Mo-unit comprises natural molybdenum.

9. The method of claim 1, wherein said low atomic number liquid is water.

10. The apparatus of claim 6, wherein said Mo-unit comprises natural molybdenum.

11. The apparatus of claim 6, wherein said low atomic number liquid is water, which serves both for cooling the Mo-100 unit and for slowing down the neutrons.

* * * * *